United States Patent [19]

Tetreault

[11] Patent Number: 4,874,105

[45] Date of Patent: Oct. 17, 1989

[54] VALVE BOX

[76] Inventor: André Tetreault, 236 Cowie Street, Granby, Canada, J2G 3B8

[21] Appl. No.: 294,748

[22] Filed: Jan. 9, 1989

[51] Int. Cl.[4] ..... B65D 88/76; F16L 57/00

[52] U.S. Cl. ..... 220/4 C; 137/366; 137/370; 220/8; 220/18

[58] Field of Search ..... 137/363–373; 220/4 C, 8, 18, 358, 378

[56] References Cited

U.S. PATENT DOCUMENTS

| | | | |
|---|---|---|---|
| 794,661 | 7/1905 | Clark | 137/371 |
| 2,887,243 | 5/1959 | Murdock, Sr. | 220/8 |
| 3,297,050 | 1/1967 | Rider | 137/369 |
| 4,065,020 | 12/1977 | Carson | 220/18 |
| 4,307,264 | 12/1981 | Hess | 220/18 |

*Primary Examiner*—Jimmy G. Foster

[57] ABSTRACT

A valve box for use with a water valve from an aqueduct branch pipe. The valve box comprises a pair of endwisely connected elongated coaxial cylinders, a cover removably mounted to the top of the upper cylinder and having a downturned cylindrical flange depending therefrom within the main cylinders, and a floor wall having an upturned cylindrical flange exteriorly of the main cylinders. Cross-sectionally V-shape, elastomeric, annular, self-tightening gaskets ensure liquid-tight interconnection of the two main cylinders, of the upper cylinder with the upper flange and of the lower cylinder with the lower flange. The rotatable shaft of the valve extends through the floor wall, wherein the cross-sectionally square head thereof can be accessed from ground level by removing the cover. The two flanges are moreover releasably locked to the cylinders by bayonet joints.

16 Claims, 2 Drawing Sheets

VALVE BOX

FIELD OF THE INVENTION

This invention relates to municipal aqueduct equipment. More particularly, the field of the present invention is directed toward valve boxes i.e. those well structures enabling access to the underground valves which control the flow of water in the branch pipe of a municipal water distribution network.

BACKGROUND OF THE INVENTION

In municipal aqueduct systems, there is included a main horizontal water pipe that is running one or more meters below ground level. Each dwelling of the municipality is fed with water via an underground branch pipe, transversely connected to and opening into said main water pipe. The branch pipe is diametrally smaller than the main pipe, and includes at least one valve which may be reached from ground level through a well. This valve is important in that it controls the flow of water from the municipal water duct, to the branch pipe of a specific house; should there be an important leak at the level of the house, the municipal workers will be able to cut water flow upstream thereof at the level of said valve, to prevent this leak.

Conventional valve boxes or well structures for gaining access to the valve shaft or spigot are not leak-proof and it often happens that surface or underground water reaches the valve body and freezes under cold weather conditions preventing closing of the valve.

Suitable ways of providing a leak-proof valve box have not been as yet proposed in the art, to the knowledge of the inventor.

OBJECTS OF THE INVENTION

The prime object of the invention is therefore to provide a leak-proof valve box or the well structure, preventing water and other debris from gaining access to the interface of the valve body and valve spigot of an underground valve.

SUMMARY OF THE INVENTION

In accordance with the teachings of the invention, there is disclosed a well structure for use with a water valve from an aqueduct branch pipe, comprising: a large, ground-engaging, elongated, tubular assembly, a cover member mounted to the top of said tubular assembly, first locking means to releasably lock said cover member to said tubular assembly, first gasket means to seal the connection of said cover member to said tubular assembly cooperatively with said first locking means, a floor member mounted to the bottom of said tubular assembly, second locking means to releasably lock said floor member to said tubular assembly, second gasket means to seal the connection of said floor member to said tubular assembly; said floor member having a through-bore through which is rotatably engaged an operative shaft of said valve, said shaft having gripping means at its free end which projects within said tubular assembly; and third gasket means, to seal the connection between said shaft and said floor member.

Preferably, said tubular assembly includes at least two self-tightening type.

Advantageously, said first gasket means includes an annular elastomeric gasket, mounted within said inner cavity of the collar member and thus taken in sandwich between the peripheral underface of said cover member and the top end of said upper tubular member, said elastomeric gasket being flattened under the weight of said cover member.

Alternately, said first gasket means includes an annular groove made into the inner wall portion of said collar member bottom end, and an annular elastomeric gasket lodged into said groove, this gasket defining a diverging leg extending inwardly upwardly from said groove, said diverging leg being taken in sandwich between the adjacent intermediate section of said upper tubular member and the collar member bottom end, wherein this gasket is of the pressure-induced self-tightening type.

It would be desirable that said cover member be made from cast iron, and said tubular members and bottom floor member be made from a rigid plastic material.

Preferably, said floor member is flat and provided with an upturned tubular flange, the top end of said flange surrounding the exterior periphery of an intermediate section of the lower one of said tubular members, said second locking means defining a bayonet joint means to releasably lock said flange to an intermediate section of said lower tubular member, said second gasket means sealing the connection of said flange to said lower interconnected rigid coaxial tubular members, and fourth gasket means to seal the connection between each pair of adjacent tubular members, the latter gasket means providing a measure of lengthwise play of one tubular member relative to the other to adjust the overall length of the tubular assembly in accordance with the vertical distance of the valve from ground level. Advantageously, said cover member is flat and flush with the ground.

Profitably, said first locking means includes a large collar member, embedded into the ground and surrounding said cover member and defining an intermediate annular inner cavity into which sits said cover member, bayonet joint means to connect said cover member to said collar, wherein the lower end of said collar member surrounds the exterior intermediate section of the uppermost one of said tubular members; said first gasket means sealing the adjacent sections of said collar member and said upper tubular member.

Preferably, the bottom end of the upper tubular member surrounds the exterior of the top end of the lower tubular member; said fourth gasket means including: an annular groove made into the inner wall portion of said upper tubular member bottom end, and an annular gasket lodged into said groove, said gasket being made from an elastomeric material and defining a diverging leg extending inwardly upwardly from said groove, said diverging leg being taken in sandwich between the adjacent said tubular members, wherein this gasket is of the pressure-induced tubular member.

It would be desirable that said floor member be flat, and that said third gasket means include a sleeved elastomeric gasket, surrounding the upright said valve shaft and frictionally locked in position within said through bore of the floor member.

In that case, said valve advantageously defines a rigid flat gland through which rotatably extends said shaft; said third gasket means further including an annular elastomeric gasket, taken in sandwich between said flat gland and said flat floor member and sealingly flattened under the weight of the earth bearing on a peripheral section of said floor member, the annular flattened gasket defining an inner edge firmly abutting against the exterior bottom peripheral edge of said sleeved gasket.

Profitably, said elastomeric gasket includes a small anchoring transverse outturned ridge, being embedded into said upper tubular member.

It is envisioned that said second gasket means would include: an annular groove, made into the inner wall portion of the top end of said floor member flange, and a further annular elastomeric gasket lodged into said groove, this gasket defining a diverging leg extending outwardly downwardly from said groove, said diverging leg being taken in sandwich between the adjacent intermediate section of said lower tubular member and said upturned flange top end, so as to seal the connection of said flange to said lower tubular member, wherein this gasket is of the pressure-induced self-tightening type.

Preferably, said shaft gripping means defines a cross-sectionally square enlarged block, suitable for socket wrench engagement and actuation, said block further defining an annular skirt member, integrally dependent from the bottom edge thereof and spacedly overlying said sleeved gasket so as to shield the latter.

DETAILED DESCRIPTION OF THE INVENTION

Figures 1, 2:
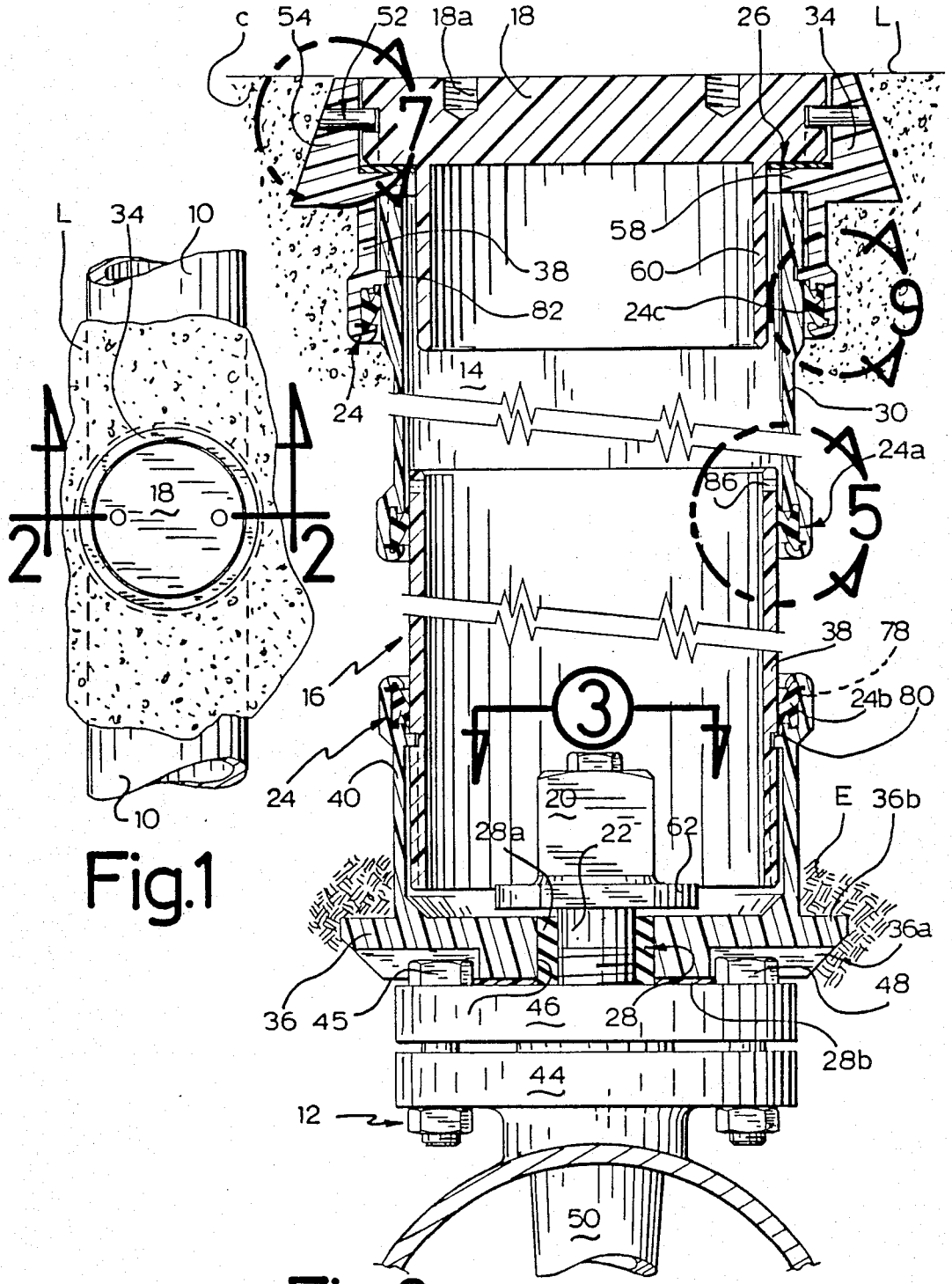
FIG. 1 is a fragmented top plan view of a valve box and of the corresponding section of water branch pipe.
FIGS. 2, 4, 8 and 10 are cross-sectional views taken along line 2—2 of FIG. 1, 4—4 of FIG. 3, 8—8 of FIG. 7 and 10—10 of FIG. 9, respectively.
Figure 3:
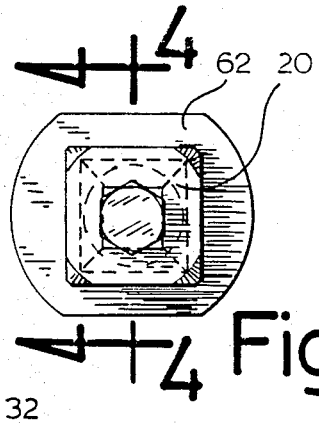
FIG. 3 is a top plan view taken below plane 3 of FIG. 2.
Figure 4:
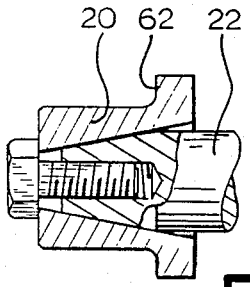

The horizontal branch pipe 10 extends in the earth E below ground level L and is transversely connected to and opens into the main aqueduct water pipe (not shown). The branch pipe 10 is diametrally smaller than the main pipe, and includes at least one valve member 12 being anchored thereto and projecting outwardly therefrom, only part thereof being shown in FIG. 2. Valve 12 may be reached from ground level L through a cylindrical vertical well 14, extending through a lower ground earth layer E and through an upper ground concrete layer C. Layer C may be a boardwalk or the like. Thus, valve 12 opens into the bottom end of well 14. The shape of well 14 is maintained by a rigid cylindrical valve box body assembly 16, with a ground level cover 18 closing the top end of cylinder 16. Hence, when actuation of valve 12 is required, cover 18 is removed and an elongated tool is inserted into well 14, within cylinder 16, to reach the cross-sectionally square nut head 20 of the valve 12. When nut 20 is rotated, the threaded shaft portion 22 of the valve 12 rotates therewith, to pivot a conventional valve flap (not shown) or the like from an opened position, coplanar to the longitudinal axis of the branch pipe 10, to a closed position transverse to pipe 10 to prevent flow of water therebeyond.

In accordance with the invention, there are introduced gasket means 24, 26, 28 for sealing the constituting elements of assembly 16 together and also cover 18 and valve 12 to cylinder assembly 16.

Cylinder assembly 16 consists of four elements 30, 32, 34, 36. Elements 30 and 32 are elongated cylindrical tubes, the upper larger tube 30 being telescopingly engaged by the lower smaller tube 32. Element 34 is a large collar having a downwardly depending annular flange 38 which is slidingly engaged by the upper section of upper tube 30. Element 36 is a large plate having an upwardly extending cylindrical flange 40 engaged by the lower section of lower tube 32. Plate 36 includes a central bore 42 for passage of the threaded stem 22 of the valve 12. Elements 30 to 36 should be made from a rigid plastic material, while cover 18 should be made from cast iron.

Valve 12 defines a large casing having a substantially flat top flange 44 to which is secured a gland 46 by bolts 48, the heads of which protrude from gland 46. The underface of plate 36 is provided with radial grooves **36*a* to clear bolt heads 48. The latter prevent rotation of plate 36 when valve shaft 22 is rotated. Plate 36 also has an annular peripheral flange section 36*b*** for a purpose to be later describes.

Figure 7:
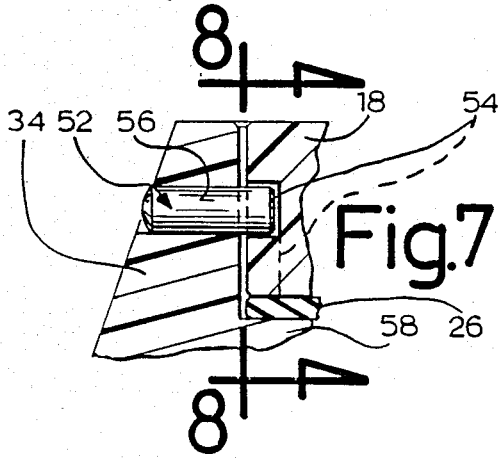
Figure 8:
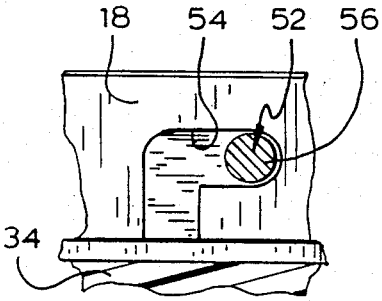

Cover 18 is anchored to collar 34 by bayonet joints 52 (see FIGS. 7–8) each formed by pin 56 fixed to collar 34 and engageable into an L-shaped cavity(?)56. Moreover, collar 34 includes an inturned flange 58 to support the peripheral edge of cover 18. A vertical cylindrical body 60 downwardly depends from cover 18 radially inwardly of horizontal flange 58. Cover 18 can be manually removed from the exterior by partial rotation and pulling by means of a suitable tool engageable with holes **18*a* at the top of cover 18**.

Gasket means 26 is simply a flattened annular elastomeric gasket being taken in sandwich between cover 18 and flange 58 of collar 34, under the action of joints 52. Elastomeric gasket means 28 include a first cylindrical gasket **28*a*, surrounding threaded stem 22 and applied against the circular wall opening of plate 36 defined by bore 42, and a second flattened gasket 28*b*, taken in sandwich between plate 36 and gland 46 under the biasing weight of the earth E on edge section 36*b* of plate 36. Preferably, head 20 is spaced from threaded rod 22 by an enlarged ridge 62, hiding gasket 28*a* from possible falling debris which would hamper the rotation of axis 22**.

Figure 5:
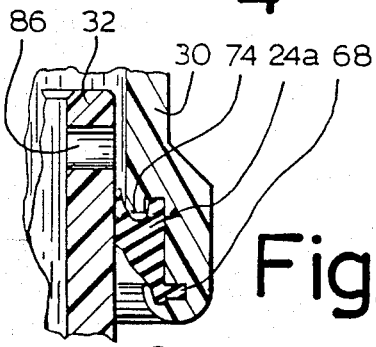
FIGS. 5, 7 and 9 are enlarged views taken within the area circumscribed by circles 5, 7 and 9 respectively of FIG. 2; and, FIG. 6 is a view similar to that of FIG. 5 but with the larger vertical valve box cylinder being removed wherein the annular gasket is in its released condition.
Figure 6:
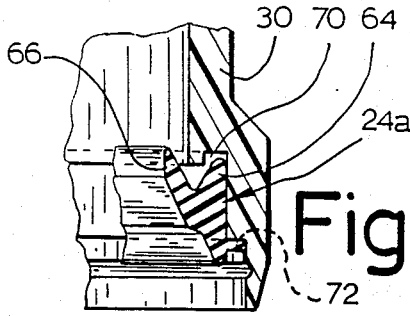

Three elastomeric gasket means 24 are used, each consisting of an annular gasket. An upper and a lower gasket **24*a*, 24*b* spacedly surround cylinder body 32, while one gasket 24*c* surrounds cylinder body 30. As illustrated in FIGS. 5–6, each gasket 24 defines a main leg 64 with another shorter leg 66 diverging by about 30° from the intermediate thickened section thereof. The free end section of leg 64 opposite leg 66 further includes a short transverse outturned ridge 68, slightly short of the free end edge thereof. Due to the resiliency of gasket 24, motion of leg 66 relative to main leg 64 is possible as suggested in the sequence FIG. 6–FIG. 5**, under a biasing pressure for self-tightening of the gasket.

Annular gasket **24*a* seals the connection between surfaces 30 and 32 by having leg 64 engage a thicknesswise annular cavity 70 made in the bottom of wall 30. A thicknesswise groove 72 is further made in the lower section of cavity 70, to accommodate outturned ridge 68, proximate to the bottom end of cylinder 30. A top short radially inwardly downturned ridge 74 of cavity 70 separates leg 66 from leg 64. When gasket 24*a* is loosely engaged into cavity 70 (FIG. 6), its leg 64 extends short of the top run of the cavity 70. However, when cylinder 32 is engaged within cylinder 30, the top end section of wall 32 will compress the gasket 24a against wall 30, and more particularly the leg 66 against the radially inner face of ridge 74 and the leg 64 to expand upwardly to fully occupy the top run section of cavity 70 (see FIG. 5**). Hence, no water will be able to seep therethrough.

Similarly, gasket 24c is lodged into a cavity 76, made into the bottom of wall 38 (FIG. 9), and abutting against an intermediate section of wall 30; and gasket 24b is lodged into a cavity 78 made into the top end of wall 40 and abutting against an intermediate section of wall 32. Of course, there may be more than two cylinder extensions 30, 32 if a deeper well 14 is desired, wherein a corresponding increase in the number of gaskets 24 would follow.

Figure 9:
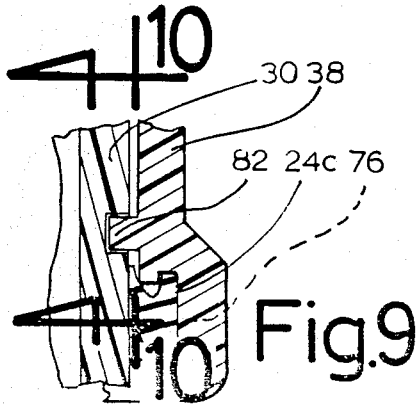
Figure 10:
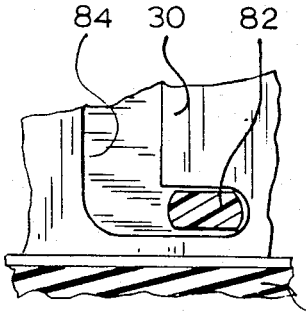

Wall 32 should be supported by and locked to wall 40 through a bayonet joint 80, and similarly, wall 30 should be supported by and locked to wall 38 through a bayonet joint 82. Bayonet joints 80 and 82 are similar. E.g., bayonet joint 82 is shown in FIGS. 9–10 and defines a radially inturned projection from wall 38, slightly above cavity 76, and an L-shape thicknesswise cavity 84 made in wall 30 and releasably engaged by the projection. Thus, cylinders 30, 32 may be easily dismantled, as for cover 18 with respect to collar 34.

The fact that there are at least two lengthwisely relative movable cylinder bodies 30, 32 enables to cut the lower tubular member 32 to the length required to provide a well of suitable depth. The assembly 16 also accommodates the expansion/retraction of the surrounding concrete, during seasonal temperature changes, without hampering the effectiveness of the sealing gaskets 24, 26, 28.

Lower tubular member 32 can be provided with orifices 86 for rotation thereof by means of a suitable tool in order to engage or release the bayonet joint 80.

Gaskets 24b, 24c are proximate to the bayonet joints, to ensure that any play thereabout of the cylinders 30 and 32 and flanges 34, 40, 60 will be fully compensated by these cup-shaped seals 24.

I claim:

1. A valve box for use with a water valve from an aqueduct branch pipe or the like, comprising: an upright, ground-engaging, elongated, tubular assembly, a cover member mounted to the top of said tubular assembly, first locking means to releasably lock said cover member to said tubular assembly, first gasket means to seal the connection of said cover member to said tubular assembly cooperatively with said first locking means, a floor member mounted to the bottom of said tubular assembly, second locking means to releasably lock said floor member to said tubular assembly, second gasket means to seal the connection of said floor member to said tubular assembly; said floor member having a through-bore for rotatably receiving an operative shaft of said valve, said shaft having gripping means at its free end adapted to project within said tubular assembly; and third gasket means, to seal the connection between said shaft and said floor member.

2. A valve box as defined in claim 1, wherein said tubular assembly includes at least two interconnected rigid coaxial tubular members, and fourth gasket means to seal the connection between each pair of adjacent tubular members, the latter gasket means providing a measure of lengthwise play of one tubular member relative to the other.

3. A valve box as defined in claim 2, wherein said cover member is flat and adapted to be flushed with ground level.

4. A valve box as defined in claim 3, wherein said first locking means includes a large collar member, adapted to be embedded into the ground and surrounding said cover member and defining an intermediate annular inner cavity into which sits said cover member, bayonet joint means to interconnect said cover member to said collar, wherein the lower end of said collar member surrounds the exterior intermediate section of the uppermost one of said tubular members; said first gasket means sealing the adjacent sections of said collar member and said upper tubular member.

5. A valve box as defined in claim 4, wherein the bottom end of the upper tubular member surrounds the exterior of the top end of the lower tubular member; said fourth gasket means including: an annular groove made into the inner wall portion of said upper tubular member bottom end, and an annular gasket lodged into said groove, said gasket being made from an elastomeric material and defining a diverging leg extending inwardly upwardly from said groove, said diverging leg being taken in sandwich between the adjacent said tubular members, wherein this gasket is of the pressure-induced self-tightening type.

6. A valve box as defined in claim 5, wherein said elastomeric gasket includes a small anchoring transverse outturned ridge, being embedded into said upper tubular member.

7. A valve box as defined in claim 4, wherein said first gasket means includes an annular elastomeric gasket, mounted within said inner cavity of the collar member and thus taken in sandwich between the peripheral underface of said cover member and the top end of said upper tubular member, said elastomeric gasket being flattened under the weight of said cover member.

8. A valve box as defined in claim 4, wherein said first gasket means includes an annular groove made into the inner wall portion of said collar member bottom end, and an annular elastomeric gasket lodged into said groove, this gasket defining a diverging leg extending inwardly upwardly from said groove, said diverging leg being taken in sandwich between the adjacent intermediate section of said upper tubular member and the collar member bottom end, wherein this gasket is of the pressure-induced self-tightening type.

9. A valve box as defined in claim 8, wherein said elastomeric gasket includes a small anchoring transverse outturned ridge, being embedded into said collar member.

10. A valve box as defined in claim 2, wherein said cover member is made from cast iron, and said tubular members and bottom floor member are made from a rigid plastic material.

11. A valve box as defined in claim 2, wherein said floor member is flat and provided with an upturned tubular flange, the top end of said flange surrounding the exterior periphery of an intermediate section of the lower one of said tubular members, said second locking means defining a bayonet joint means to releasably lock said flange to an intermediate section of said lower tubular member, said second gasket means sealing the connection of said flange to said lower tubular member.

12. A valve box as defined in claim 11, wherein said second gasket means includes: an annular groove, made into the inner wall portion of the top end of said floor member flange, and a further annular elastomeric gasket lodged into said groove, this gasket defining a diverging leg extending outwardly downwardly from said groove, said diverging leg being taken in sandwich between the adjacent intermediate section of said lower tubular member and said upturned flange top end, so as to seal the connection of said flange to said lower tubular member, wherein this gasket is of the pressure-induced self-tightening type.

13. A valve box as defined in claim 12, wherein said elastomeric gasket includes a small anchoring transverse outturned ridge embedded into said upturned flange.

14. A valve box as defined in claim 1, wherein said floor member is flat, and said third gasket means includes a sleeved elastomeric gasket, surrounding the upright said valve shaft and frictionally locked in position within said through bore of the floor member.

15. A valve box as defined in claim 14, wherein said valve defines a rigid flat gland through which rotatably extends said shaft; said third gasket means further including an annular elastomeric gasket, taken in sandwich between said flat gland and said flat floor member, the latter annular flattened gasket defining an inner edge firmly abutting against the exterior bottom peripheral edge of said sleeved gasket.

16. A valve box as defined in claim 14, wherein said shaft gripping means defines a cross-sectionally square enlarged block, suitable for socket wrench engagement and actuation, said block further defining an annular skirt member, integrally dependent from the bottom edge thereof and spacedly overlying said sleeved gasket so as to shield the latter.

* * * * *